US009706612B2

(12) United States Patent
Ramaker

(10) Patent No.: US 9,706,612 B2
(45) Date of Patent: Jul. 11, 2017

(54) METHOD AND CIRCUIT FOR CONTROLLING AN LED LOAD

(75) Inventor: Antonius Everardus Theodorus Ramaker, Delft (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 1370 days.

(21) Appl. No.: 13/061,154

(22) PCT Filed: Aug. 28, 2009

(86) PCT No.: PCT/EP2009/061139

§ 371 (c)(1),
(2), (4) Date: Feb. 28, 2011

(87) PCT Pub. No.: WO2010/023280

PCT Pub. Date: Mar. 4, 2010

(65) Prior Publication Data

US 2011/0148313 A1 Jun. 23, 2011

Related U.S. Application Data

(60) Provisional application No. 61/092,520, filed on Aug. 28, 2008.

(51) Int. Cl.

| | |
|---|---|
| ***H05B 37/00*** | (2006.01) |
| ***H05B 33/08*** | (2006.01) |
| ***H05B 37/02*** | (2006.01) |
| ***H05B 41/36*** | (2006.01) |
| ***H05B 39/04*** | (2006.01) |

(52) U.S. Cl.

CPC ..... *H05B 33/0815* (2013.01); *H05B 37/02* (2013.01); *H05B 39/04* (2013.01); *H05B 41/36* (2013.01)

(58) Field of Classification Search

CPC .... H05B 33/0815; H05B 33/08; H05B 37/02; H05B 39/04; H05B 41/36

USPC ..... 315/185, 283, 185 R, 224, 247, 307

See application file for complete search history.

(56) References Cited

U.S. PATENT DOCUMENTS

| | | | | |
|---|---|---|---|---|
| 7,015,654 | B1 * | 3/2006 | Kuhlmann et al. | 315/291 |
| 7,276,861 | B1 | 10/2007 | Shteynberg et al. | |
| 8,344,707 | B2 * | 1/2013 | Melanson | G05F 1/70 323/222 |
| 2007/0188114 | A1 * | 8/2007 | Lys et al. | 315/308 |
| 2008/0054815 | A1 * | 3/2008 | Kotikalapoodi | H05B 33/0815 315/192 |

(Continued)

FOREIGN PATENT DOCUMENTS

| | | | |
|---|---|---|---|
| KR | 2007107891 | * | 11/2007 |
| WO | WO2008068682 | A | 12/2008 |

OTHER PUBLICATIONS

Search Report of PCT/EP2009/061139 issued by the EPO Nov. 10, 2009.

*Primary Examiner* — Tung X Le

(57) ABSTRACT

The invention relates to a method for controlling an LED load. First an input voltage is supplied to an inductive element. Subsequently, a current is drawn through the inductive element for a first predetermined time period. Finally, a current is supplied from the inductive element to a first terminal of the LED load during a second time period. The first predetermined time is controlled to maintain a predetermined average current through the LED load.

20 Claims, 5 Drawing Sheets

(56) References Cited

U.S. PATENT DOCUMENTS

| | | | | |
|---|---|---|---|---|
| 2009/0273292 | A1* | 11/2009 | Zimmermann .... | H05B 33/0818<br>315/209 R |
| 2009/0302774 | A1* | 12/2009 | Mednik ..... | H05B 33/0815<br>315/209 R |
| 2010/0026208 | A1* | 2/2010 | Shteynberg ..... | H05B 33/0815<br>315/297 |

* cited by examiner

METHOD AND CIRCUIT FOR CONTROLLING AN LED LOAD

CROSS-REFERENCE TO RELATED APPLICATIONS

This application claims the priority benefit under 35 U.S.C. §371 of International Patent Application No. PCT/EP2009/061139, filed Aug. 28, 2009, which claims the priority benefit of U.S. Application No. 61/092,520 filed Aug. 28, 2008, the entire contents of both of which are herein incorporated by reference.

BACKGROUND OF THE INVENTION

1. Field of the Invention

The present invention relates to a method and circuit for controlling an LED load.

2. Description of the Related Art

Light Emitting Diodes (LEDs) are increasingly used in a wide range of applications. LEDs require current regulation instead of voltage regulation. An LED driving circuit, also referred to as LED driver, may be considered as a type of power conversion circuit that delivers a regulated current. However, if an LED, or a series of LEDs, requires a voltage of 12V and is connected to a 12 VAC-source, known LED drivers are highly inefficient as they need to be able to raise the voltage when the voltage provided by a rectified 12V AC-source is below 12V, and, at the same time, need to be able to lower the voltage when the voltage provided by a rectified 12V AC-source is above 12V in order to ensure that a constant current is delivered.

U.S. Pat. No. 7,276,861 describes a system and method for driving an LED in which the system includes a switching power converter that can be a step-up switching converter, also referred to as boost converter, or a step-down switching converter, also referred to as buck converter. The boost converter is used if the source voltage should be boosted. The buck converter is used if the source voltage should be decreased. Alternatively a buck-boost topology is used, i.e. a boost converter and buck converter are combined in a single circuit. The switching power converter includes an inductor, and a switch. The converter operates with an on-time phase when the switch is closed and an off-time phase when the switch is open. Energy is stored in the inductor during on-time of the switch, while during off-time of the switch, the energy is discharged into the LEDs. If both boost and decrease of voltage are needed, i.e. a buck-boost topology is used, the switching power converter comprises more components than a regular boost or buck converter, i.e. typically at least an additional switch and an additional diode.

Furthermore, the switching power converter comprises a current comparator to enable regulation of the length of the switch on time. By measuring the current through the inductor during off-time of the switch, a suitable on and off time of the switch may be determined. However, the need for a current comparator makes the circuit more complex and costly than necessary.

Hence, a circuit as described in U.S. Pat. No. 7,276,861 is relatively complex and costly to manufacture. Furthermore, a compact circuit is highly desirable, especially in applications where LEDs are replacing conventional lighting that does not require a driving circuit. Thus, there is a need for a simple low cost driver circuit with a minimum number of components.

BRIEF SUMMARY OF THE INVENTION

It is an object of the invention to provide a method and a circuit for controlling an LED load which overcomes or reduces the effects of problems mentioned above. This object is achieved by providing method for controlling an LED load, the method including the steps of supplying an input voltage to an inductive element, drawing a current through the inductive element for a first predetermined time period, and supplying a current from the inductive element to a first terminal of the LED load during a second time period, wherein the first predetermined time period is controlled to maintain a predetermined average current through the LED load.

In one aspect of the invention, a circuit is provided for controlling an LED load, the circuit comprising an inductive element and a connection control element connected in series across an input voltage, the connection control element having an ON-state when a current is drawn through the inductive element and an OFF-state. The circuit also includes an LED load having a first terminal electrically connected between the inductive element and connection control element, for receiving a current supplied by the inductive element when the connection control element is in an OFF-state, and a control unit for controlling the connection control element to have an ON-state during a predetermined ON time period and an OFF-state during a predetermined OFF time period to maintain a predetermined average current through the LED load.

In another aspect of the invention is a method for controlling an LED load comprising supplying an input voltage to an inductive element, drawing a current through the inductive element for a first predetermined time period, and supplying a current from the inductive element to a first terminal of the LED load during a second time period. The first predetermined time period corresponds to a first portion of a predetermined control cycle, and the second time period corresponds to a second portion of the control cycle, and the first predetermined time period or the control cycle period is controlled to maintain a predetermined average current through the LED load.

In a further aspect of the invention, a method is provided for controlling an LED load, the method including supplying an input voltage to an inductive element, drawing a current through the inductive element for a first predetermined time period, and supplying a current from the inductive element to a first terminal of the LED load during a second time period, wherein the first predetermined time period is controlled to maintain a substantially fixed voltage difference between the input voltage and a voltage on the first terminal.

Further aspects of the invention are defined in the dependent claims.

BRIEF DESCRIPTION OF THE DRAWINGS

Various aspects of the invention will be further explained with reference to embodiments shown in the drawings wherein.

DESCRIPTION OF ILLUSTRATIVE EMBODIMENTS

The following is a description of certain embodiments of the invention, given by way of example only.

Figure 1:
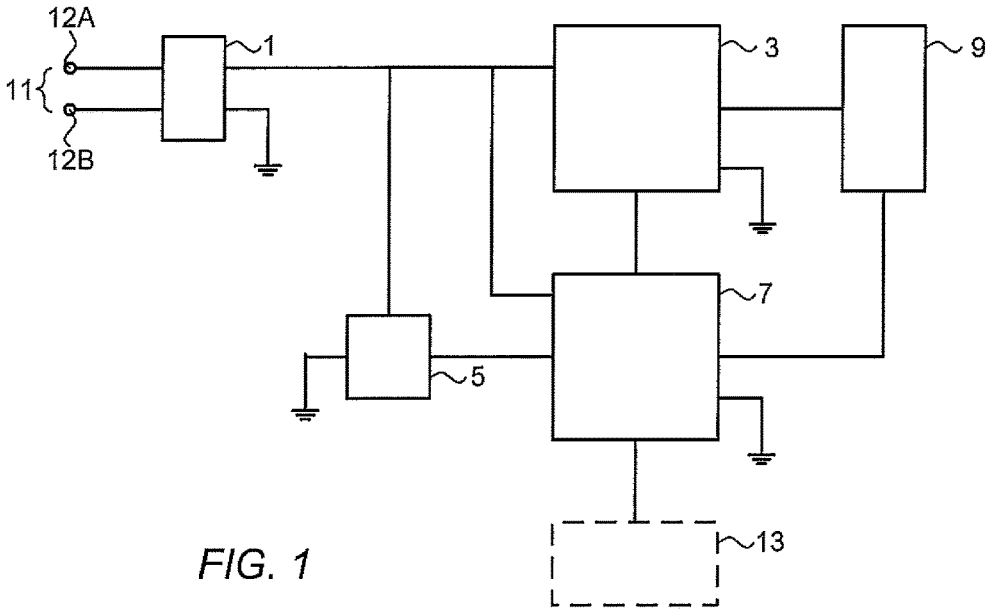
FIG. 1 shows a block diagram of a circuit for controlling an LED load used in embodiments of the invention.

FIG. 1 shows a block diagram of a circuit for controlling an LED load used in embodiments of the invention. The circuit comprises a conditioning unit 1, a converter 3, a stabilizing unit 5 and a control unit, e.g. microcontroller 7. The circuit is arranged to provide a substantially fixed voltage across an LED load 9.

The conditioning unit 1 is connected to an input power supply 11, e.g. via terminals 12A and 12B. The input power supply may be alternating current (AC) or direct current (DC) having a voltage in a suitable range. For example, an unregulated AC power supply with 17V peak voltage, derived using a transformer from a 240V 50 Hz or 120V 60 Hz AC supply, or an unregulated 12 VDC supply, may be used. An "electronic transformer" may be used, chopping the incoming mains voltage (e.g. 230 V 50 Hz AC) and subsequently transforming the result to low level using a small high frequency power transformer. The output voltage of the electronic transformer is a sine-wave having the shape of the incoming mains voltage multiplied by +1 and −1 according to the chopping frequency used (typically in the range 25 kHz to 150 kHz) and an effective value of for example, 12 V. The circuit for controlling an LED load can operate with this type of input power, for example by using an input rectifier with Schottky diodes which are inherently very fast. The converter 3 is connected to the conditioning unit 1, and is arranged to receive the conditioned input parameters, i.e. input voltage and input current. The converter is controlled by the microcontroller 7.

The microcontroller 7 is powered by the conditioned input voltage, which is stabilized by stabilizing unit 5. The converter 3 converts the input parameters into output parameters, i.e. an LED current, based on control signals received from the microcontroller 7. The control of the microcontroller 7 is such that the current through the LED load 9 is maintained at a predetermined value (which may include a. The microcontroller 7 may execute a programmed sequence of instructions, and may be programmed via an external link with a computer program product 13.

Figure 2:
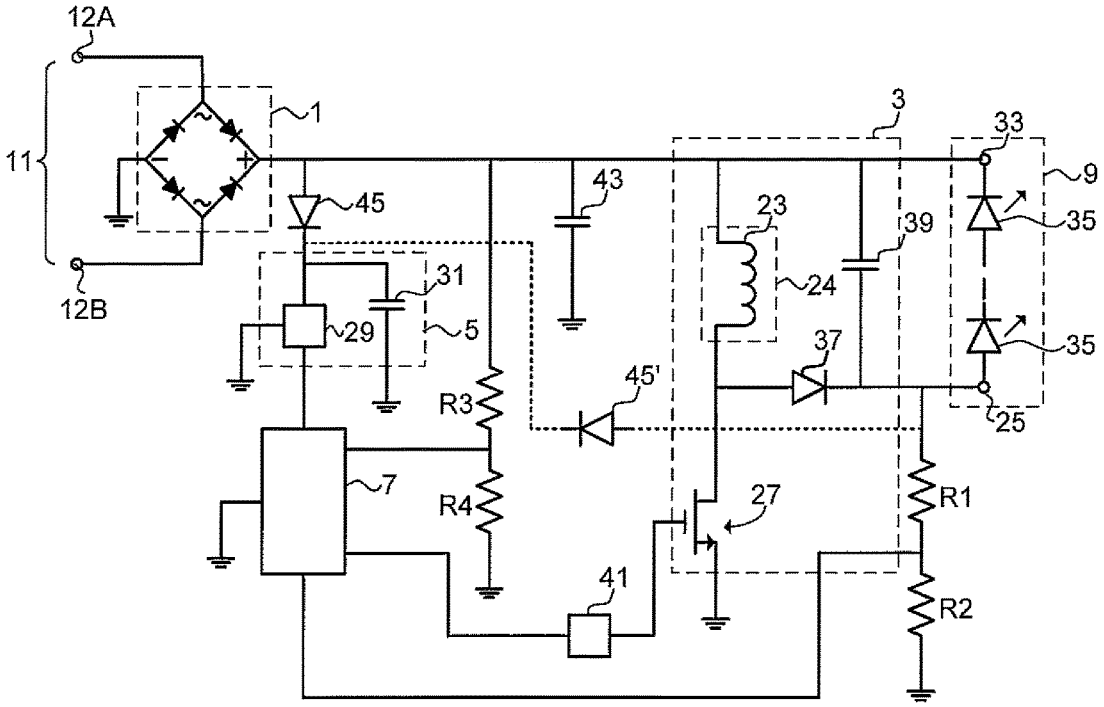
FIG. 2 shows a more detailed lay-out of a circuit for controlling an LED load according to an embodiment of the invention as schematically shown in FIG. 1.

FIG. 2 shows a more detailed layout of a circuit for controlling an LED load according to an embodiment of the invention as schematically shown in FIG. 1. In the embodiment shown, the conditioning unit 1 comprises a rectifying diode bridge 21, although other types of conditioning circuits may be used. If the input power supply is AC, the rectifying diode bridge 21 rectifies the AC input to produce a pulsating DC voltage. If the input power supply is DC, the rectifying diode bridge 21 will simply transfer the DC voltage. This enables the circuit to be used for both AC and DC power supplies without requiring alteration to the circuitry.

The converter 3 comprises an inductive element 23 connected between the input voltage and a first terminal 25 of the LED load 9. In one embodiment, the inductive element 23 is a coil. The coil may be surrounded by a magnetic shielding casing 24 to reduce interaction with other components in the circuit by confining the magnetic flux by means of magnetic shielding.

The converter 3 further comprises a connection control element 27, e.g. a switch, which is connected in series to the inductive element 23. In the embodiment shown, the connection control element is a field effect transistor (FET) switch, although other types of control or switching elements may also be used. If the switch is closed, so that the FET connects one terminal of the inductive element 23 to common (i.e. the ground or common terminal for the circuit), current is drawn through the inductive element 23, and energy is stored in the inductive element 23. If the switch is opened, so that the inductive element 23 is disconnected from common, the stored energy in the inductive element 23 will be discharged and the current flowing through inductive element 23 will be supplied to the first terminal 25 of the LED load. A suitable switch includes a 40V, SI2318 MOSFET. The connection control element 27 is controllable by the microcontroller 7 such that a current can be drawn through the inductive element for a first predetermined time period, and a current can be supplied from the inductive element to the first terminal 25 of the LED load 9 during a second time period.

The stabilizing unit 5 comprises a stabilizer 29 and a capacitor 31. The stabilizer 29 provides regulation of the input voltage sufficient to enable reliable operation of the microcontroller 7. A suitable stabilizer 29 includes a positive voltage regulator, e.g. of type 78L05. A suitable microcontroller 7 includes a microcontroller of the type Atmel Tiny 45, manufactured by Atmel Corporation, 2325 Orchard Parkway, San Jose, Calif. 95131, and may be flash programmable by means of a compiled C-based language program to optimize machine code.

The LED load 9 is connected between a first terminal 25 and a second terminal 33. In the embodiment shown, the LED load 9 comprises two or more LEDs 35 connected in series, although other circuit arrangements may also be used. The driver circuit may be adapted to drive any type of LED. The LEDs 35 may be arranged to emit light with a wavelength of substantially the same wavelength, or alternatively, with different wavelengths.

In the embodiment shown, the microcontroller 7 thus controls the control element 27 to control the time periods during which the switch is open and during which the switch is closed. The microcontroller 7 is arranged to control the connection control element 27 such that the first predetermined time period is controlled to maintain a predetermined average current through the LED load 9. A substantially fixed voltage across the LED load is maintained, i.e. in the embodiment schematically depicted in FIG. 2, equal to the voltage difference between the voltage on the first terminal 25 and the input voltage, being the second terminal 33 of the LED load 9. This control scheme makes the circuit very flexible, because the variation at the input voltage is effectively decoupled from the voltage across the LED load 9.

In one embodiment, the converter 3 further comprises a unidirectional element 37 connected between the inductive element 23 and the first terminal 25 of the LED load 9. The unidirectional element 37 permits current flow from the inductive element 23 to the LED load 9 while preventing current flow in the reverse direction. The unidirectional element 37 may be a diode, preferably a Schottky diode. A suitable Schottky diode includes a B340 Schottky barrier rectifier. The unidirectional element 37 prevents the first terminal 25 of the LED load 9 from being connected to common when the switch is in the ON-state. A Schottky diode has the advantage over an ordinary silicon PN junction that is has a much smaller forward voltage drop, i.e. 0.1-0.4 V instead of typically 0.6-0.7 V.

In an embodiment, the converter 3 further comprises a capacitor 39 connected between the first terminal 25 of the LED load 9 and the second terminal 33 of the LED load 9. The capacitor 39 may be used to smooth current variations so as to improve delivery of a substantially constant current to the LED load 9.

In an embodiment, the microcontroller 7 may base its control of the connection control element 27 on determining the input voltage and the voltage on the first terminal 25 by measurement. Voltage measurements may be performed by using voltage divider arrangements. A voltage divider arrangement comprising resistors R1 and R2 may be used for measuring the voltage on the first terminal 25. Similarly, a voltage divider arrangement comprising resistors R3 and R4 may be used for measuring the input voltage. Typical values for R1, R2, R3 and R4 are 47 kΩ, 4.7 kΩ, 47 kΩ and 4.71 kΩ respectively.

In an embodiment, a buffer 41 is provided between the microcontroller 7 and the connection control element 27. The buffer 41 may improve the efficiency of the circuit by providing a larger drive current to enable a short switch-off time of the connection control element 27. At the moment when the connection control element 27 switches to its OFF-state, a large voltage develops across the switch and for a short period current will continue to flow through the switch at an elevated voltage. In order to minimize dissipated power during this period, the period of time during which this process occurs is preferably minimized by providing a larger driving current to the control terminal (e.g. gate or base terminal) of the switch via the buffer 41. The buffer 41 may comprise a circuit comprising two complementary bipolar transistors, or other suitable circuits well known to those of skill in the art.

In one embodiment, an additional capacitor 43 may optionally be connected between ground and the second terminal 33 of the LED load 9. The additional capacitor 43 may serve as a supply reservoir for large currents drawn by inductive element 23. Note that the capacitor 43 is relatively small and can be omitted entirely, and the circuit of FIGS. 1 and 2 operates without a large energy storage capacitor. This results a in a smaller circuit with a better power factor than circuits having a large storage capacitor.

The input voltage provided via the conditioning unit 1 may be used to power the microcontroller 7. In such an embodiment, an additional unidirectional element 45, e.g. a diode, may be connected between the conditioning unit 1 and the stabilizing unit 5. If the input voltage exceeds the supply voltage needed to drive the microcontroller 7, typically about 7 V, energy may be stored in a capacitor 31 in the stabilizing unit 5. The additional unidirectional element 45 enables driving the microcontroller 7 while the input voltage is below the minimum supply voltage needed to drive the microcontroller 7 by enabling the capacitor 31 to supply power to the microcontroller 7 during these periods. Low input voltage may occur due to variation in the input voltage (whether AC or DC) and will also occur at regular intervals during the zero crossings of an AC input voltage (e.g. every 10 ms for a 50 Hz AC input voltage).

In another embodiment, instead of positioning a unidirectional element 45 between the conditioning unit 1 and the stabilizing unit 5, a unidirectional element 45' may be positioned between the first terminal 25 of the LED load 9 and the stabilizing unit 5 (the connection being schematically shown in FIG. 2 by the dashed line). This arrangement permits the microcontroller 7 to operate for longer periods when the input voltage is too low, by powering the microcontroller 7 from the controlled voltage at terminal 25, but has the disadvantage of slightly reduced efficiency, as the inductive element 23 must now supply enough additional current to power the microcontroller 7.

Figure 3:
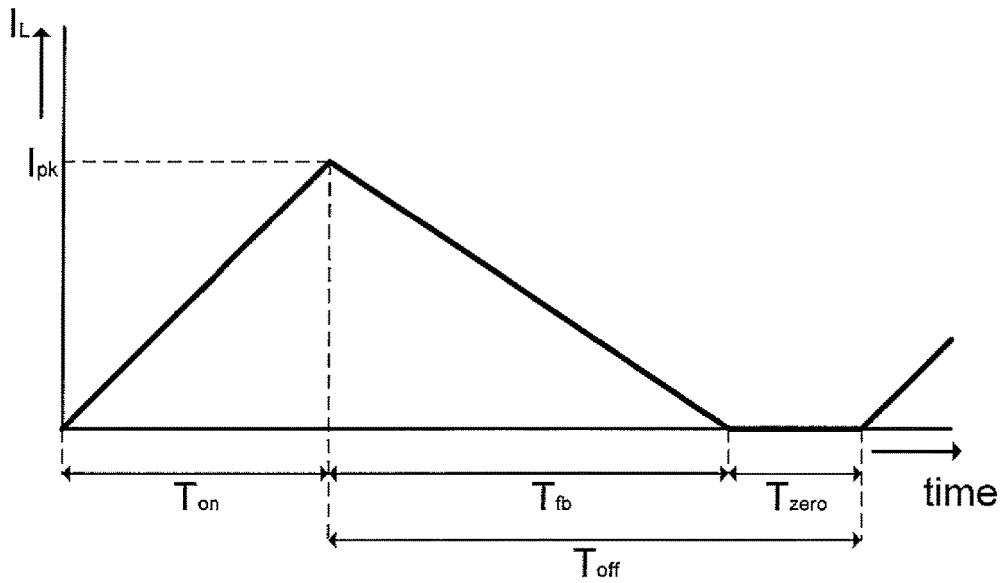
FIG. 3 shows a graph of inductor current as a function of time if controlled according to an embodiment of the invention.

FIG. 3 shows a graph of an inductor current $I_L$ flowing through inductive element 23 as a function of time when $I_L$ is controlled according to an embodiment of the invention. An LED load requires control of the current flowing through the LEDs to maintain a steady light output. The control unit, e.g. microcontroller 7 as schematically depicted in FIGS. 1 and 2, is thus arranged to control the current flowing through the LED load, further referred to as $I_{LED}$. The control unit can control $I_{LED}$ via a connection control element, e.g. a switch. If the switch is arranged in a first position, further referred to as the ON-state, a current is drawn through the inductive element in the circuit. If the switch is arranged in a second position, further referred to as the OFF-state, a current is supplied from the inductive element to a first terminal of an LED load. By tuning the time periods of the ON-state and the OFF-state, a suitable $I_{LED}$ can be provided.

FIG. 3 schematically shows one period of a repeating control cycle to generate a suitable $I_{LED}$. The control cycle preferably has a frequency much higher than the frequency of the input voltage (where an AC input voltage is used). For a typical application where the AC input has a supply frequency of 50 or 60 Hz, the control cycle may have a frequency in the order of hundreds of kHz, e.g. 200 kHz.

During a first predetermined time period $T_{on}$, defined by the control unit, the switch is in the ON-state. During $T_{on}$ the voltage across the inductive element 27 is essentially equal to the input voltage. When the input power in AC, the rectified AC input voltage will be constantly changing. However, the control cycle frequency is much higher than the input voltage frequency, so that the rectified input voltage is substantially constant during the period $T_{on}$ and the rise in current flow through the inductive element 27 is substantially uniform during period $T_{on}$.

With a substantially constant voltage across the inductive element 27, the inductor current $I_L$ increases in a substantially linear fashion. If ideal components are used, and $I_L$ starts from zero current, $T_{on}$ may be defined as:

$$T_{on} = \frac{LI_{pk}}{V_{IN}} \tag{1}$$

where L is the inductance of the inductive element and $V_{IN}$ is the input voltage.

At the end of the calculated period $T_{on}$, when the peak current $I_{pk}$ has been reached, the control unit instructs the switch to switch to the OFF-state. The inductor now supplies a current to the LED load during a second time period, releasing the energy stored in the inductor. The current through the inductive element, $I_L$, decreases in a substantially linear fashion as well. The second time period, also referred to as fall back time $T_{fb}$, is equivalent to the time it takes for $I_L$ to decrease from $I_{pk}$ to zero current, and assuming ideal components are used is given by:

$$T_{fb} = \frac{LI_{pk}}{V_{LED}} \tag{2}$$

where $V_{LED}$ is the voltage across the LED load.

The first predetermined time period $T_{on}$ may correspond to a first portion of the control cycle, while the second time period $T_{fb}$ may correspond to a second portion of the control cycle. The combined period $T_{on}+T_{fb}$ may be less than the complete a control cycle time period, so that there is an additional time period $T_{zero}$ until the control unit instructs the connection control element to switch to the ON-state again. Time period $T_{zero}$ then corresponds to a third portion of the control cycle. The time period corresponding to $T_{fb}+T_{zero}$ is denoted as $T_{off}$. Hence, a single control cycle time period is equivalent to $T_{on}+T_{off}$.

The period $T_{on}$ may be controlled to achieve a certain peak current $I_{pk}$ to result in a long term desired average of current $I_{LED}$ through the LED load. During the complete control cycle $T_{on}+T_{fb}+T_{zero}$, current is supplied to the LED load during period $T_{fb}$. The amount of current supplied to the LED load during period $T_{fb}$ is a function of the current flowing at the beginning of the period ($I_{pk}$), the current flowing at the end of the period, and the duration of the period $T_{fb}$. The current $I_{pk}$ is a function of L, $T_{on}$ and $V_{IN}$ according to equation (1), and period $T_{fb}$ is a function of L, $I_{pk}$ and $V_{LED}$ according to equation (2). Thus, for given values of $V_{IN}$ and $V_{LED}$, the current supplied during period $T_{fb}$ can be controlled by controlling period $T_{on}$.

In embodiments of the circuit which include a capacitor between the first and second terminals of the LED load (capacitor 39 in FIG. 2) the current supplied during period $T_{fb}$ will be smoothed during each control cycle. A suitable capacitance may be 10 μF for a 350 mA LED current through a 12V LED load, assuming an inductive element of 4.7 μH.

The above control scheme assumes a fixed total control cycle period ($T_{on}+T_{fb}+T_{zero}$) and controlled $T_{on}$ period. An alternative is to control the length of the total control cycle while keeping $T_{on}$ constant. In this scheme, for example, the period $T_{zero}$ may be increased to reduce the average current supplied to the LED load over the control cycle, or $T_{zero}$ may be decreased to increase the average current supplied. Another alternative is to control both $T_{on}$ and the length of the total control cycle, so that an average current is supplied at the desired level.

As mentioned above, the complete control cycle period is relatively short, and the desired average of current $I_{LED}$ through the LED load is preferably the desired average over a large number of control cycles. Where the input power is AC, there will be control cycles which occur in the period around each zero crossing of the AC input voltage, during which no current is supplied to the LED load. The desired long term average of current $I_{LED}$ thus may be calculated so that more current is supplied during the remaining control cycles to account for the control cycles during which no current flows.

Note that the current supplied during period $T_{fb}$ can be controlled in this way because the period $T_{fb}$ is sufficiently long that the current flowing through the inductive element falls substantially to zero at the end of period $T_{fb}$. Thus, in embodiments controlled using equations (1) and (2), $T_{off}$ is equal to or larger than $T_{fb}$. This ensures that the current is substantially zero at the end of $T_{fb}$ and each control cycle starts with a substantially zero current through the inductive element. This is a "discontinuous mode" control scheme and has the advantage that measurement of current is not required; the control is performed solely based on measurement of input and output voltage. This eliminates the need for current measurement circuitry, which is more complex and bulky than the simple voltage divider circuits which may be used for voltage measurements. However, a more sophisticated control algorithm is required when using only voltage measurements, as explained in detail below.

In order to obtain information related to the input voltage and the voltage across the LED load, voltages may be measured by using voltage divider arrangements that are suitably positioned in the circuit. The control unit may then determine the voltage at the required points in the circuit based on the measured voltages and knowledge of the resistors used in the respective voltage divider arrangements. In one embodiment, the control unit may take measurements of input voltage repeatedly at various times to determine various voltages, such as the peak voltage, minimum voltage, average voltage, etc. during a cycle of an AC input voltage. The control unit may then use these values to calculate certain derived values. For example, the control unit may be arranged to calculate a ratio between the peak input voltage and the average input voltage. The ratio between peak and average input voltage may be used, for example, to recognize whether voltage variations at the input relate to dimming conditions or not as will be described further with reference to FIGS. 7*a*, 7*b* and 8. The control unit may comprise a memory to, at least temporarily, store measurement data and intermediate results of calculations.

As will be understood by a person skilled in the art, in order to calculate $T_{on}$, the control unit further needs to know the inductance of the inductive element in the converter. A suitable inductance for obtaining a 350 mA LED current $I_{LED}$ through a 12V LED load may be 4.7 μH.

In an embodiment, the control unit comprises a timer. Time period $T_{on}$ may then be based on discrete control increments of the timer. As will be understood by a person skilled in the art, alternating lengths of $T_{on}$ may be supplied to the connection control element to obtain an average $T_{on}$ with a length unequal to an increment of the timer. A timer may be implemented as a counter and compare circuit in a microcontroller comprising the control unit. Implementing such a timer function in the microcontroller has the advantage of reducing the calculations required in the microcontroller during each control cycle.

The aforementioned scheme enables the control unit to control an LED current $I_{LED}$ through an LED load without the use of current measurement. Consequently, fewer components are needed in the circuit as compared to circuits presently known in the art. The circuit takes a small amount of space, which makes the circuit suitable to be used for LED lighting in regular lamp fittings, e.g. in an LED replacement for use in an MR16 fitting designed to accommodate a halogen lamp.

In embodiments of the invention, the frequency of the control cycle $f_{cc}$ is constant, i.e.

$$f_{cc} = \frac{1}{(T_{on} + T_{off})} \tag{3}$$

As mentioned earlier, in order to ensure that each control cycle starts with a substantially zero current through the inductive element, the fall back time $T_{fb}$ may not be larger than $T_{off}$. However, as follows from equation (1), if a certain $I_{pk}$ needs to be reached to obtain a desired average of LED current $I_{LED}$, a smaller input voltage $V_{IN}$ will result in a larger value for $T_{on}$. It follows from equation (2) that in such a situation, given a fixed voltage across the LED load, i.e. $V_{LED}$, is required, the fall back time $T_{fb}$ will not change. Hence, below a certain threshold voltage obtaining the desired peak value of the current through the inductive element will result in $T_{on}+T_{fb}$ exceeding the time period of the control cycle, i.e. $T_{cc}=T_{on}+T_{off}$, which is undesirable.

In order to avoid situations in which, at the moment of switching the connection control element to the ON-state, the current through the inductive element is unequal to zero, the control unit may set an allowed maximum target current ($I_{pk}$) when the input voltage is below a certain threshold. This may be done by storing the maximum target current for a series of input voltages below the threshold voltage in a lookup table in the control unit in a way known to a person skilled in the art.

During the ON-state, the current through the inductive element $I_L$ increases until the relevant maximum target current has been reached. Then, the connection control element switches to the OFF-state, and the current through the inductive element $I_L$ falls back to zero before the connection control element switches back to the ON-state.

If the input voltage $V_{IN}$ is higher than the threshold voltage, $T_{on}$ may be calculated by using the following equation:

$$T_{on} = \sqrt{2 \cdot L \cdot T_{cc} \cdot I_{O,AVG}} \cdot \frac{\sqrt{V_{LED}}}{V_{IN}} \tag{4}$$

where $I_{O,AVG}$ is the average current provided to the LED load during a single control cycle time period $T_{cc}$. The control cycle average current $I_{O,AVG}$ may be different from the desired long term average of current $I_{LED}$. This will usually be the case for an AC input power supply because the long term average of current $I_{LED}$ takes account of control cycles when no current is supplied to the LED load, as explained above. The desired $I_{O,AVG}$ may be determined based on different algorithms depending on the desired behavior of the LED current as a function of time.

Control of the control unit can be optimized with respect to different parameters as will be discussed with reference to FIGS. 4*a*, 4*b*, 5*a*, 5*b*, 6*a* and 6*b*.

Figure 4A:
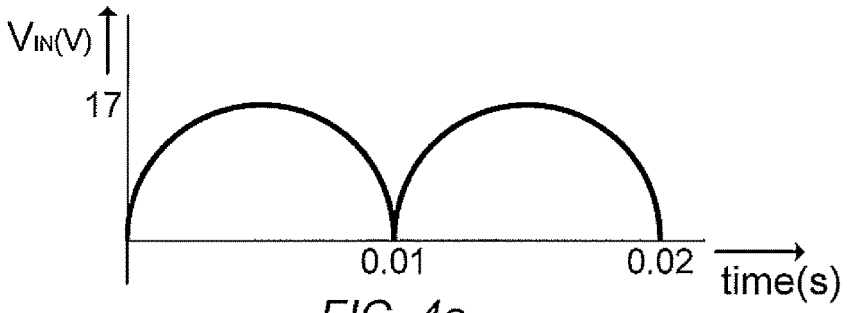
FIGS. 4*a-b* show a graph of an input voltage and LED voltage as a function of time respectively.
Figure 4B:
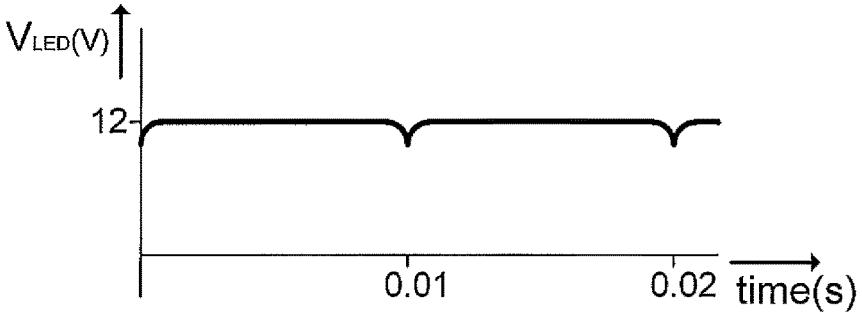

FIGS. 4*a-b* show a graph of a rectified AC input voltage $V_{IN}$ and an LED voltage $V_{LED}$ as a function of time. In this example, an AC input is supplied to the circuit having a supply duty cycle with a frequency of 50 Hz, which gives a rectified input voltage having a frequency of 100 Hz. As a result of operation of the control unit in the circuit as described with reference to FIG. 3, the LED voltage remains substantially constant (see FIG. 4*b*), while the input voltage varies (see FIG. 4*a*). That is, the LED voltage experiences a small decrease around zero crossings, e.g. a voltage drop of about 15-20%.

Figure 5A:
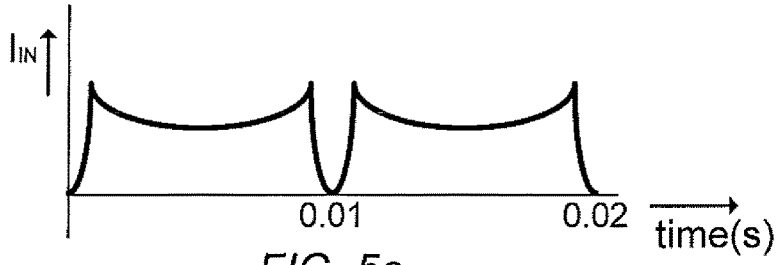
FIGS. 5*a-b* show a graph of input current and LED current as a function of time respectively if a first algorithm is used.
Figure 5B:
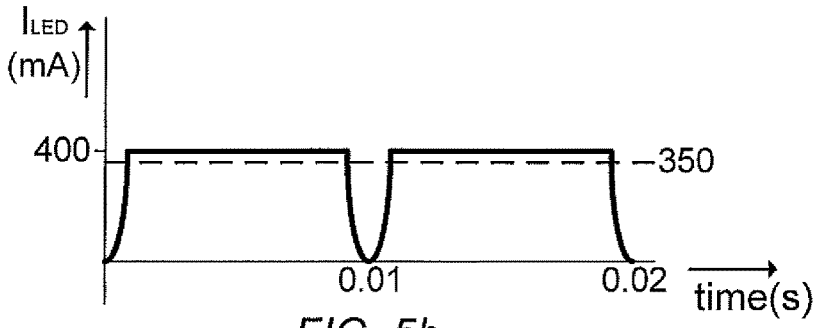

FIGS. 5*a-b* show a graph of input current $I_{IN}$ and LED current $I_{LED}$ as a function of time corresponding to the input voltage and LED voltage shown in FIGS. 4*a* and 4*b* respectively. The LED current is controlled in accordance with a first algorithm.

The first algorithm is designed in such a way that $I_{LED}$ remains constant for a maximum period of time. As mentioned earlier, below a threshold value of the input voltage, the current through the LED will be limited due to the fact that each control cycle needs to start with zero current running through the inductive element. Furthermore, if the control unit is powered from the rectified input voltage, it may cease to function once the input voltage has dropped too far (near the AC power supply zero crossing points). However, if the input voltage exceeds the threshold value, the first algorithm controls $T_{on}$ to maintain the average current supplied during each control cycle equal to the control cycle average current $I_{O,AVG}$, even though a higher current could be reached if $T_{on}$ would have been fixed. It then follows from equation (4) that $T_{on}$ will decrease. This means that, because $T_{fb}$ remains the same, $T_{zero}$ if $T_{cc}$ is constant.

Generally, the control cycle average current $I_{O,AVG}$ is slightly higher than the desired long term average of LED current. If, for example, an average LED current $I_{LED}$ of 350 mA is desired, the control unit may instruct the connection control element in such a way that an LED current $I_{LED}$ of 400 mA is provided for a maximum period of time. During this period, the current is controlled during each control cycle to supply the control cycle average current $I_{O,AVG}$ of 400 mA. At periods when the input voltage is too low for the control unit to supply this current during each control cycle, $I_{LED}$ will be less than the desired average. The control cycle average current $I_{O,AVG}$ is calculated so that the average current supplied over each 0.01 second cycle of the rectified input voltage (denoted by the dotted line in FIG. 5*b*) will correspond to the desired average LED current of 350 mA. This calculation may be performed in the control unit, or a calculation may be done in advance and derived values stored in a lookup table in the control unit.

FIG. 5A shows the input current to the circuit resulting from controlling the LED current as shown in FIG. 5*b*. A peak in the input current is produced as the circuit supplies current $I_{O,AVG}$ during control cycles when the input voltage is low. As the input voltage rises the supplied current remains substantially constant and as a result the input current drops. The input current begins rising again and exhibits another peak just before the input voltage drops to zero. These peaks in the input current result in the circuit having a non-zero power factor. The control algorithm of the control unit may be used to alter the shape of the input current to improve the power factor.

Figure 6A:
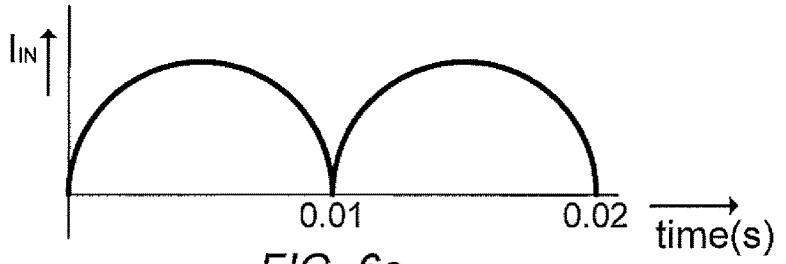
FIGS. 6*a-b* show a graph of input current and LED current as a function of time respectively if a second algorithm is used.
Figure 6B:
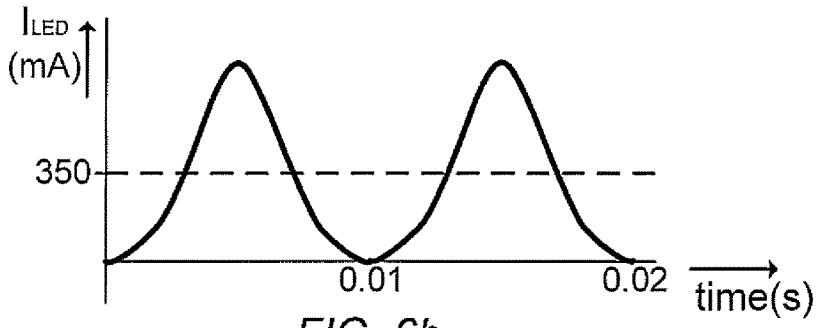

FIGS. 6*a-b* show a graph of input current and LED current as a function of time corresponding to the input voltage and LED voltage shown in FIGS. 4*a* and 4*b* respectively. The LED current is controlled in accordance with a second algorithm. The second algorithm is designed in such a way that the variation in $I_{LED}$ follows $V_{LED}$ providing the circuit with an improved power factor, preferably higher than 0.7 and, under some conditions, may approach about 0.95. A high power factor is desired by electricity network providers in order to ensure efficient generation and transport of electricity, and may affect electricity tariffs, as will be understood by persons skilled in the art.

As can be seen in FIGS. 6*a* and 6*b*, $I_{IN}$ and $I_{LED}$ follow a similar variation over each cycle of the input voltage, corresponding to the variation of $V_{IN}$ as schematically depicted in FIG. 4*a*. In one variation, the control cycle average current $I_{O,AVG}$ rises proportionally to the input voltage (during the period when the input voltage is sufficiently high to enable operation of the circuit) so that the input current exhibits a similar variation. The similar variation in input voltage and current results in an improved power factor. For a power factor of 1 to occur, the input current to the converter (as "seen" by the AC supply) is made proportional to the supply voltage (i.e. a resistive characteristic). In such case, the control cycle average current $I_{O,AVG}$ has a quadratic relationship with $V_{IN}$, because $I_{O,AVG}=V_{IN}\times I_{IN}/V_{LED}$ (A) at any moment in time. Note that this equation refers to input and output power being equal, ignoring converter losses for simplicity. $V_{LED}$ (V) can be considered more or less constant during operation, and $V_{IN}$ (V) as well as $I_{IN}$ (V) have the same wave shape, having been designed to be mutually proportional. So the wave shape of $I_{O,AVG}$ (A) is the shape of $I_{IN}$ (A) (or $V_{IN}$ (V)) squared. An input voltage having a sine wave shape will then result in a wave shape of the control cycle average current corresponding to a sine-squared wave shape.

It should be noted that this control scheme results in a higher peak LED current $I_{LED}$, e.g. about 700 mA when an average LED current $I_{LED}$ of 350 mA is desired (see dotted line in FIG. 6*b*). The LEDs and other components in circuit will need to be specified to accommodate this larger peak current.

The circuit as described with reference to FIGS. 1 and 2 and control method as described with reference to FIG. 3 also enable efficient control of modified input voltage signals, e.g. an input voltage modified by an external dimming circuit.

Figure 7A:
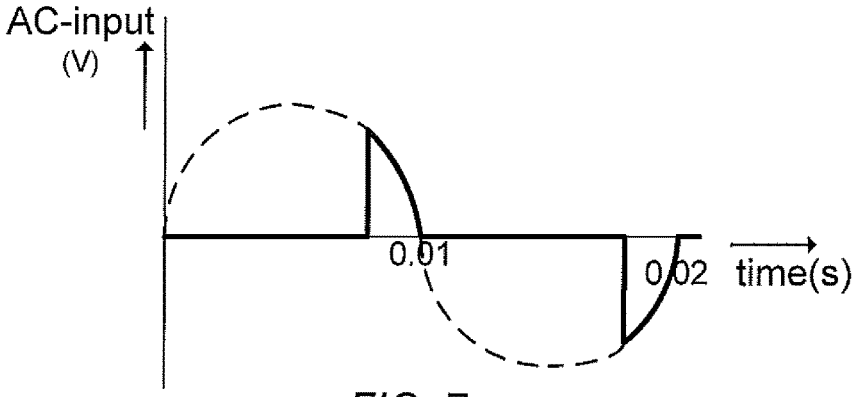
FIGS. 7*a-b* schematically show graphs to illustrate the concept of dimming.
Figure 7B:
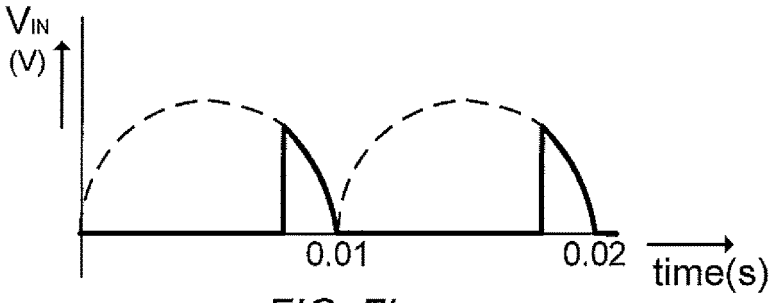

FIGS. 7*a-b* schematically show graphs to illustrate the concept of dimming. Dimming relates to controlling the amount of electrical power provided to a light emitting load, e.g. an LED load 9 as shown in FIG. 2. The greater the power applied to the load, the more intense the generated illumination and vice versa. Conventional dimming by using a so-called TRIAC-based dimmer is accomplished by turning an AC waveform on when a TRIAC turns on at a specified time within the AC cycle. The TRIAC turns off after a zero-crossing. The later the TRIAC turns on within the AC cycle, the less power is applied to the load.

FIG. 7*a* schematically shows a graph of an AC 50 Hz input voltage as a function of time. FIG. 7*a* relates to a dimmed situation as only a very limited portion of the original waveform (depicted by dotted line) is applied to the load. A corresponding rectified input voltage $V_{IN}$ as a function of time has been schematically depicted in FIG. 7*b*.

Figure 8A:
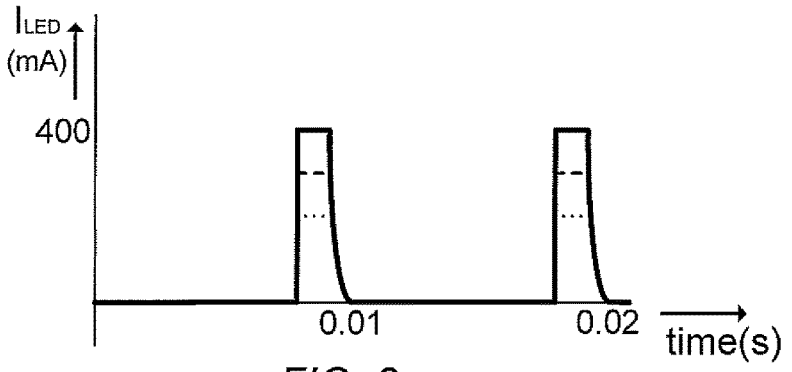
FIG. 8*a* shows a graph of LED current as a function of time in case an input voltage as schematically shown in FIG. 7*b* is supplied.

FIG. 8*a* schematically shows a graph of LED current as a function of time in when an input voltage as schematically shown in FIG. 7*b* is supplied. In the embodiment shown, the first algorithm has been used, i.e. the algorithm already discussed with reference to FIGS. 5*a* and 5*b*. As the input voltage $V_{IN}$ is only supplied for a limited period of time, the current through the LED load is only present for a limited period of time as well. Consequently, less light will be produced and the light will appear to be dimmed. However, the light intensity during the limited period of time will be similar to a non-dimmed situation. As the human eye will only notice the difference if the limited period of time during which current runs through the LED load is small enough, dimming will be a rather abrupt process and may be difficult to handle for consumers turning a dimmer knob or the like.

In one embodiment, the control unit is arranged to recognize that voltage variations of the input voltage relate to a dimmed situation. Such recognition of a dimmed situation may be established by calculating a ratio between a peak value of the input voltage and an average value of the input voltage over a cycle of the input voltage, e.g. 0.02 s for a 50 Hz AC input voltage. Based on the ratio between peak voltage and average voltage as calculated, the control unit may determine whether a dimmed condition applies or not. Alternatively, the control unit may be arranged to measure a time interval during which the input voltage is about zero to determine a "dimming angle". Based on the time interval as measured, the control unit may determine whether a dimmed condition applies or not. If the control unit determines that a dimmed condition applies, it may amend its control scheme for the connection control element which effectively results in less current being provided to the LED load during the limited period of time. This arrangement results in a circuit that can react to the voltage waveform generated by a conventional dimming circuit by correspondingly dimming the LED load, so that the circuit is compatible with conventional external dimming circuits.

Examples of such a resulting limited LED current $I_{LED}$ have been shown in FIG. 8*a* as a dashed line and dotted line respectively.

In one embodiment, the control unit is provided with an additional input, e.g. a voltage divider including a variable resistor under automated or manual control, which indicates to what extent dimming is desired. The control unit may then provide a limited LED current $I_{LED}$, for example in a way as discussed above.

Figure 8B:
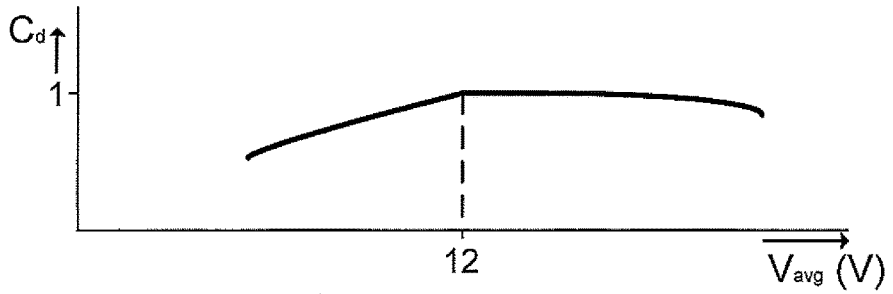
FIG. 8*b* schematically shows a graph of a dimming coefficient as a function of average voltage across a LED load.

In an embodiment, amending the control scheme may include using a dimming coefficient which equals 1 if $I_{O,AVG}$ should not be limited for dimming purposes and less than 1 if a drop in LED intensity is desired. The dimming coefficient may depend on the average voltage across the LED load. FIG. 8*b* schematically shows a graph of a dimming coefficient $C_d$ as a function of average voltage across the LED load for a LED load requiring 12 V for normal operation. Note that above 12V, the $I_{O,AVG}$ may also be limited. Such limitation ensures that the peak current through the inductor increases in a limited way with increasing voltage in order to protect the circuit components from excessive peak currents.

Figure 9A:
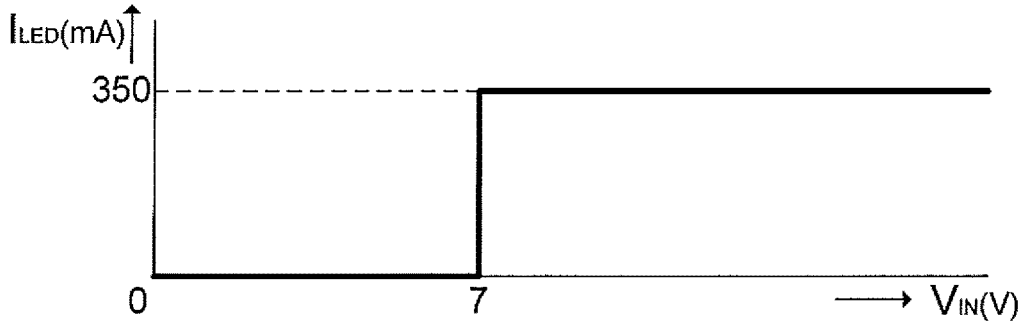
FIGS. 9*a-b* show a graphs of LED current as a function of input voltage in case of a DC-input.
Figure 9B:
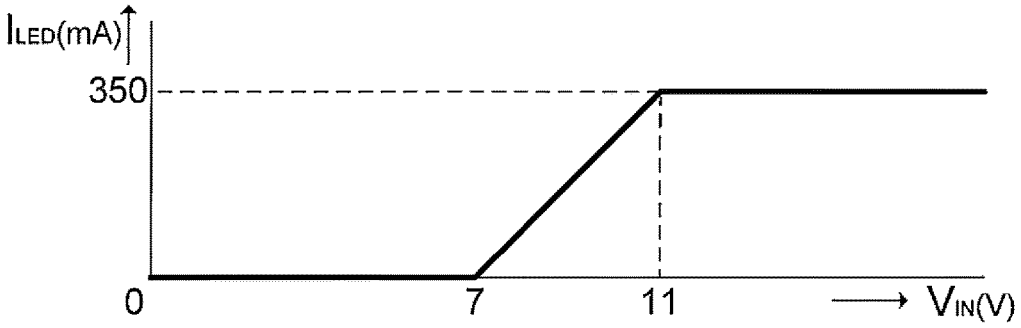

The invention has been described by reference to embodiments operating with an AC input. It will be understood that embodiments of the invention may also be used with a direct current (DC) input. In such a case, the microcontroller may be arranged to supply a certain LED current $I_{LED}$, e.g. 350 mA, to an LED load above a certain input voltage, as shown in FIG. 9*a*. Dimming is possible by arranging the control to be such that the LED current gradually increases to the desired current. FIG. 9*b* shows an exemplary graph of LED current $I_{LED}$ as function of input voltage $V_{IN}$ in which $I_{LED}$ starts flowing at a voltage of 7 V. The supplied current $I_{LED}$ gradually increases with increasing input voltage until the desired $I_{LED}$ for full operation of the LED load is achieved, i.e. in the example shown in FIG. 9*b* at 11V the desired $I_{LED}$ of 350 mA is provided.

In an embodiment, the control unit may be able to determine whether the input voltage relates to an AC input or a DC input. For example, a peak voltage and an average voltage of the input voltage may be determined by measurement, e.g. in a way as discussed before. The control unit may then compare the peak voltage and the average voltage. If the average voltage lies within a certain percentage of the peak voltage, e.g. 20%, the input voltage relates to a DC input. Otherwise, the input voltage relates to an AC input.

Embodiments of the invention have been described having a 50 Hz AC power supply input, but the circuit may also be used with 60 Hz supply, or some other frequency. In one embodiment, the control unit may be able to determine whether the input voltage relates to a 50 Hz AC input of a 60 Hz AC input. This may be accomplished, for example, by measuring the average input voltage over a predetermined period of time of 50 ms. Over 50 ms, a rectified 50 Hz input voltage will have five half cycles, and a rectified 60 Hz input voltage will have six half cycles. Thus, both 50 Hz and 60 Hz inputs will have a discrete number of half cycles over 50 ms and an average calculation over this period will result in a correct determination of an average value. This has the advantage that the same control unit can be used for both 50 Hz and 60 Hz power supplies.

Thus, the invention has been described by reference to certain embodiments discussed above. It will be recognized that these embodiments are susceptible to various modifications and alternative forms well known to those of skill in the art without departing from the spirit and scope of the invention. Accordingly, although specific embodiments have been described, these are examples only and are not limiting upon the scope of the invention, which is defined in the accompanying claims.

What is claimed is:

1. A method for controlling an LED load, the method comprising:

supplying an input voltage to an inductive element;

measuring said input voltage;

drawing a current from said input voltage through said inductive element for a first time period;

supplying a current from said inductive element to a first terminal of said LED load during a second time period via a unidirectional element;

measuring an output voltage on the first terminal of said LED load; and controlling said first time period when the current is drawn through the inductive element based on said measured input voltage and said measured output voltage to maintain a predetermined average current through said LED load, wherein the second time period includes a time interval for the current through the inductive element to reduce from a peak current flowing at the end of the first time period to a substantially zero current.

2. The method according to claim 1, wherein the first time period is controlled so that the current flowing through the inductive element during the second time period substantially equals said predetermined average current through said LED load.

3. The method according to claim 1, wherein said first time period corresponds to a first portion of a control cycle, and said second time period corresponds to a second portion of said control cycle.

4. The method according to claim 3, wherein said control cycle comprises a third portion during which substantially no current flows though said inductive element.

5. The method according to claim 1, wherein said input voltage is a rectified AC voltage, and said average current over said control cycle is based on a long term average current representing an average current on one or more cycles of said rectified AC voltage.

6. The method according to claim 1, wherein said first time period is controlled based on an inverse of said measured input voltage and a square root said measured output voltage.

7. The method according to claim 1, further comprising determining a peak input voltage and average input voltage from said measured input voltage.

8. The method according to claim 7, wherein the method further comprises:

determining, based on a ratio between said peak input voltage and said average input voltage, whether a dimmed condition applies, and if such a dimmed condition applies, altering the first time period accordingly.

9. A circuit for controlling an LED load, the circuit comprising:

an inductive element and a connection control element connected in series across an input voltage, said connection control element having an ON-state when a current is drawn from such input voltage through said inductive element, and connection control element having an OFF-state;

said LED load having a first terminal electrically connected between said inductive element and connection control element, for receiving a current supplied by said inductive element when said connection control element is in an OFF-state;

a unidirectional element connected between the inductive element and the first terminal of said LED load; and a control unit having a first input terminal for measuring said input voltage and having a second input terminal for measuring an output voltage on said first terminal of said LED load, wherein said control unit is configured to control said connection control element based on the measured input voltage and the measured output voltage to have an ON-state during an ON time period and an OFF-state during an OFF time period to maintain a predetermined average current through said LED load, wherein the OFF time period includes a time for the current through the inductive element to reduce from a peak current flowing at the end of the first time period to a substantially zero current.

10. The circuit according to claim 9, wherein said input voltage is a rectified AC voltage, and said average current over said control cycle is based on a long term average current representing an average current on one or more cycles of said rectified AC voltage.

11. The circuit according to claim 9, wherein said control unit is arranged to determine a peak input voltage and average input voltage from said measured input voltage and wherein the control unit is further arranged to determine, based on the determined ratio between peak voltage and average voltage, whether a dimmed condition applies, and if such a dimmed condition applies, to alter the ON time period accordingly.

12. The circuit according to claim 9, wherein the control unit is further arranged to measure a time interval during which the input voltage is about zero and wherein the control unit is further arranged to determine, based on the measured time interval, whether a dimmed condition applies, and if such a dimmed condition applies, to alter the ON time period accordingly.

13. The circuit of claim 9, wherein said OFF time period comprises a portion during which substantially no current flows though said inductive element.

14. A method for controlling an LED load, the method comprising:

supplying an input voltage to an inductive element;

drawing a current from the input voltage through said inductive element for a first time period;

supplying a current from said inductive element to a first terminal of said LED load during a second time period via a unidirectional element, controlling said first time period to maintain a substantially fixed voltage difference between said input voltage and a voltage on said first terminal, determining a peak input voltage and average input voltage from said measured input voltage, determining, based on a ratio between said peak input voltage and said average input voltage, whether a dimmed condition applies, and if such a dimmed condition applies, altering the first time period accordingly.

15. The method according to claim 14, wherein the first time period is controlled so that the current flowing through the inductive element during the second time period maintains said voltage difference.

16. The method according to claim 14, wherein the second time period includes a time interval for the current through the inductive element to reduce from a peak current flowing at the end of the first time period to a substantially zero current.

17. The method according to claim 14, wherein said first time period is controlled based on an inverse of said measured input voltage and a square root said measured output voltage.

18. The method of claim 14, further comprising:

measuring the input voltage;

measuring an output voltage on a terminal of said LED load, said terminal receiving said supplied current from said inductive element, and controlling said first time period based on said measured input voltage and said measured output voltage.

19. The method of claim 14, wherein said first time period corresponds to a first portion of a control cycle, and said second time period corresponds to a second portion of said control cycle.

20. The method of claim 19, wherein said control cycle comprises a third portion during which substantially no current flows though said inductive element.

* * * * *